US005267449A

United States Patent [19]

Kiczek et al.

[11] Patent Number: 5,267,449

[45] Date of Patent: Dec. 7, 1993

[54] METHOD AND SYSTEM FOR CRYOGENIC REFRIGERATION USING AIR

[75] Inventors: Edward F. Kiczek, Long Valley, N.J.; Joseph M. Petrowski, Pottstown, Pa.

[73] Assignee: Air Products and Chemicals, Inc., Allentown, Pa.

[21] Appl. No.: 886,658

[22] Filed: May 20, 1992

[51] Int. Cl.[5] ..... F25B 9/00

[52] U.S. Cl. ..... 62/86; 62/93; 62/401

[58] Field of Search ..... 62/93, 86, 87, 88, 401, 62/402

[56] References Cited

U.S. PATENT DOCUMENTS

| | | | |
|---|---|---|---|
| 2,084,474 | 6/1937 | Booth et al. | 62/87 |
| 2,602,307 | 7/1952 | Collison | 62/401 |
| 3,623,332 | 11/1971 | Fernandes | 62/87 |
| 3,696,637 | 10/1972 | Ness et al. | 62/88 |
| 3,733,848 | 5/1973 | Duron et al. | 62/381 |
| 3,868,827 | 3/1975 | Linhardt et al. | 62/63 |
| 4,192,662 | 3/1980 | Ogata et al. | 62/13 |
| 4,315,409 | 2/1982 | Prentice et al. | 62/63 |
| 4,317,665 | 3/1982 | Prentice | 62/63 |
| 4,584,838 | 4/1986 | Abujudom, III | 62/87 |

*Primary Examiner*—Ronald C. Capossela

*Attorney, Agent, or Firm*—James C. Simmons; William F. Marsh

[57] ABSTRACT

A method and system for cooling air to cryogenic temperatures [e.g., below −100° F. (−730° C.)] for use as a refrigerant medium for direct contact cooling of articles such as foodstuffs for fast freezing.

14 Claims, 1 Drawing Sheet

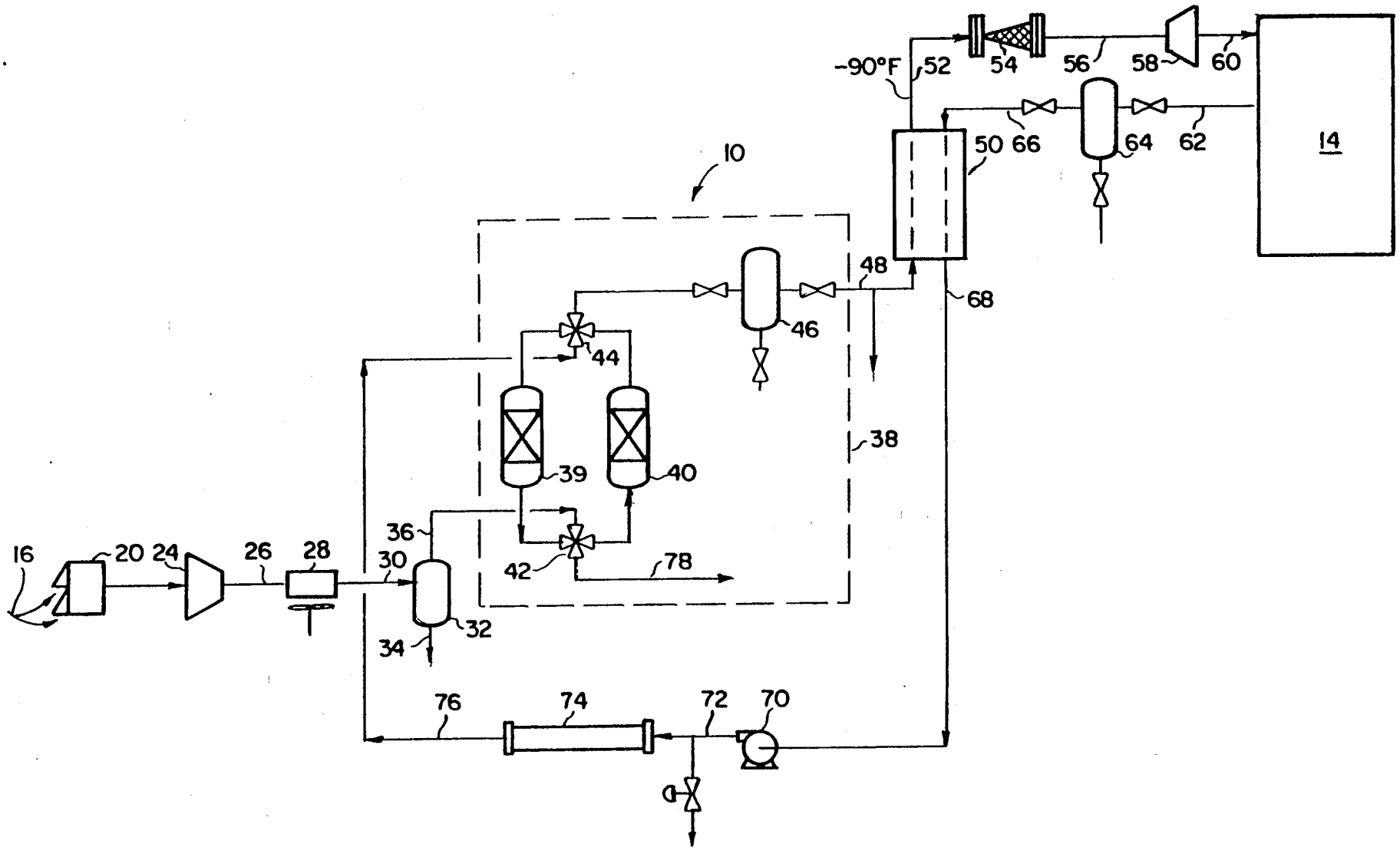
14
60
62
58
64
56
66
54
50
68
52
-90°F
48
38
46
10
70
40
78
72
44
39
42
74
32
76
36
30
34
28
26
24
20
16

METHOD AND SYSTEM FOR CRYOGENIC REFRIGERATION USING AIR

FIELD OF THE INVENTION

The present invention relates to a method and system for cooling air to cryogenic temperatures, the cooled air to be used for, inter alia, introduction into a freezer for quick freezing articles such as foodstuffs.

BACKGROUND OF THE INVENTION

U.S. Pat. Nos. 4,315,409 and 4,317,665 disclose and claim improvements to cryogenic freezing systems utilizing air at cryogenic temperatures such as disclosed in U.S. Pat. Nos. 3,733,848 and 3,868,827. In the systems of the foregoing patents, air taken from that surrounding the apparatus to be cool ed, e. g., food freezer, is cooled to temperature below −180° F. so that when introduced into the freezer at this temperature quick freezing of articles in the freezer can take place. Such freezers find use in the food industry for quick freezing foods for preservation and shipping of the foods.

The prior art systems rely upon the recirculation of the atmosphere from the freezing compartment after extracting some of the refrigeration by recompression and expansion to achieve the very low temperatures. Problems with the recycle system center on the fact that the federal government requires thorough cleaning and sanitation of this type of equipment. A recycle system embodied in a heavy piece of equipment such as a system including compressors and the like to take air from ambient temperature to below −180° F. are generally not easily opened up for cleaning. Thus such systems are susceptible to frost buildup and the recycle of bacteria particles and frost particles since the atmosphere is constantly reused.

SUMMARY OF THE INVENTION

The present invention pertains to the use of a cryogenic air refrigeration cycle whereby very cold air in gaseous form is produced by a series of intercooled stages of a compressor and a turbo expander. The cold gas is supplied to an insulated enclosure to accomplish quick freezing of articles contained inside of the insulated enclosure. Once such insulated enclosure is a conventional cryogenic food freezer, wherein the food to be frozen is contacted by air at temperatures of below approximately −200° F. (−129° C.). Air withdrawn or exiting from the insulated compartment is integrated into the system and is used after heat exchange with air to be cooled for injection into the insulated compartment prior to expansion. The withdrawn air is warmed to an elevated temperature to regenerate systems for moisture and gaseous contaminant removal from the compressed air stream prior to cooling and expansion. A portion of withdrawn air is subjected to sterilization prior to being used for regeneration and then is vented to the atmosphere. Thus, the method and apparatus of the invention rely on non-recirculating air to avoid the problems of the prior art systems.

BRIEF DESCRIPTION OF THE DRAWING

The single figure of the drawing is a schematic representation of the method and system (apparatus) according to the present invention.

DETAILED DESCRIPTION

One of the significant problems in using mechanical refrigerators to freeze foodstuffs is that at temperatures produced by mechanical refrigerators utilizing chlorofluorocarbons or ammonia as a refrigerant, the product being frozen, especially foodstuffs, are subject to severe dehydration and loss of flavor and quality when used by the ultimate consumer. Mechanical refrigerators can produce cold air at temperatures approximately −35° F. (−37° C.). Cryogenic food freezers utilizing liquid nitrogen are well known and will serve to prevent excessive dehydration. However, cryogenic food freezers utilizing a cryogen other than air, e.g., nitrogen or carbon dioxide, are expensive and do have the problem of safely venting vaporized cryogen in and around the freezing apparatus.

According to the present invention the method and system permit the use of air to achieve all of the efficiency and product enhancement using cryogenic freezing of prior art devices with the additional benefits of reduced freezer frost build-up, reduced maintenance time and costs, and improved sanitation due to the fact that the air is used only once in a true open cycle configuration.

Referring to the drawing, the system 10 includes an insulated enclosed space 14. Insulated enclosed space 14 represents, among other things, a conventional food freezer of the spiral, impingement, or tunnel type such as are well known in the art. Insulated enclosed space represented by 14 is cooled by taking a stream of air 16 passing the stream of air 16 through a particulate air filter 20 of the type that will filter out over 98% of particulate matter having a size greater than 20 microns average diameter. The filtered air is conducted via a conduit 22 to a multi-stage compressor 24, the inlet air having a temperature in the range of approximately 20° F. (−6.7° C.) to 105° F. (40.5° C.) and a pressure of 14.1 psia (97.21 Kpa). Compressor 24 is a multi-stage (e.g. four-stage) compressor with intercooling so that the air in conduit 26 exiting the compressor 24 is at approximately 198 psia (1365.01 Kpa) and approximately 200° F. (93° C.). Conduit 26 conducts the compressed and heated air to an aftercooler 28 where the compressed air stream is cooled without loss of pressure to within plus or minus 10° F. of ambient and conducted via conduit 30 to a separator 32 where water is removed from the compressed air stream. Water from separator 32 can be removed via conduit 34 for disposal as is well known in the art. The compressed air stream is conducted from separator 32 via conduit 36 to a dryer/particulate removal arrangement, the components being outlined in box 38 which includes at least two vessels 39 and 40 containing material, e.g. molecular sieves for moisture and gaseous contaminant removal. Depending upon the type of material in the vessels 39, 40 in addition to removal of final amounts of water vapor, gaseous contaminants such as carbon dioxide can also be removed. The system 38 includes the necessary switching valves 42, 44 so that the vessels 39 and 40 can be onstream and/or regenerated as is well known in the art. Also included in the dryer/particulate removal arrangement 38 is a particulate trap 46 to remove any carryover sieve material or other particulates in the compressed air stream. The compressed air stream is conducted from trap 46 via conduit 48 to a heat exchanger 50 where the compressed air stream is cooled to a temperature of approximately −90° F. (−68° C.) without loss of more than a negligible amount of pressure. The cooled compressed air stream is conducted from heat exchanger 50 via conduit 52 through a particulate strainer 54 into conduit 56 for introduction into a turbo expander 58. Particulate strainer 54 is included to protect the turbo expander 58. The cooled gas stream exits turbo expander 58 via conduit 60 at approximately −250° F. (−157° C.) and 15.2 psia (104.79 Kpa) where it is injected into the insulated space 14 for producing a cooled refrigerated space for cooling or freezing articles contained therein. As in all balanced flow refrigeration system, air that has given up its all or part of its refrigeration capacity is withdrawn from the insulated space via conduit 62 and is passed through an ice and particle filter 64 to conduit 66 through heat exchanger 50 where the air entering heat exchanger at approximately −100° F. (−73° C.) and 14.7 psia (97.21 Kpa) exits the heat exchanger 50 in conduit 68 at approximately 13.3 psia (91.69 Kpa) and 90° F. (32.2° C.). The warmed withdrawn gas stream in conduit 68 is introduced to a blower 70, exits blower 70 through conduit 72 is introduced into a sterilizer 74 such as a ultraviolet light sterilizer, exits sterilizer 74 through conduit 76 and then can be introduced into the system 38 for regenerating the vessels 39, 40 and then exits the system through conduit 78. Alternatively the withdrawn air can be discharged from the system via conduit 78. The withdrawn air is never recycled into the system but is used only for regenerating the adsorbers in system 38, thus there is no contamination of the incoming air since the withdrawn air has been sterilized and there is no ice buildup in the recycled air because it has been passed through the ice and particulate filter 64.

The compressor 24 and expander 58 are joined by providing an additional pinion in the compressor for mounting of the expander. The compressor can be run by a double shafted 1,500 horsepower induction motor which can also be used to drive the vacuum blower 70. The entire system except for the insulated container 14 can be mounted on a skid for ease in installation into an existing plant utilizing other types of refrigeration systems. The aftercooler 28 can be a closed loop glycol radiator system which can be used to provide cooling for the interstages of the main air compressor 24 as well as providing cooling of the discharge from the main air compressor. The insulated container 14 can be a freezer such as a spiral type food freezer.

From the foregoing it can be seen that air can be used to produce cryogenic temperatures for cooling an insulating container or for effecting food freezing with minimum dehydration and product deterioration during the freezing process. The system of the present invention achieves the elimination of recycling bacteria and frost particles, minimizing freezer frost buildup and thus reducing the maintenance costs and improving the sanitation of the system.

Having thus described our invention, what is claimed and desired to be secured by Letters Patent of the U.S. as set forth in the appended claims:

1. A method of producing a refrigerated atmosphere inside of an enclosed space comprising the steps of:

passing a stream of ambient air through a particulate filter;

compressing said filtered stream of air to an elevated pressure and temperature;

cooling said compressed stream of air to a temperature approximately that of the ambient environment;

removing moisture and gaseous contaminants from said compressed stream of air while maintaining approximately the same temperature and pressure of said stream of air;

cooling said compressed stream of air to a temperature below 0° F. (−17.8° C.);

expanding said compressed stream of air to a cryogenic temperature and a pressure slightly above atmospheric;

introducing said stream of air at cryogenic temperature into said enclosed space;

removing air from said enclosed space after said air is warmed by heat exchange inside said enclosed space; and using said removed air outside said enclosed space.

2. A method according to claim 1 wherein said compressed stream of air is cooled prior to expansion by heat exchange with cold air withdrawn from said enclosed space.

3. A method according to claim 2 wherein said withdrawn air is subjected to ice and particle removal before heat exchange with said compressed stream of air.

4. A method according to claim 2 wherein said withdrawn air after heat exchange is sterilized and used to regenerate equipment used for said moisture and gaseous contaminant removal step.

5. A method according to claim 1 wherein said cooled compressed stream of air is subjected to a particulate removal step prior to expansion.

6. A system for cooling articles to temperatures below −100° F. (−73° C.) comprising in combination;

insulated means for containing the articles to be cooled and an environment consisting of air cooled to below −100° F. (−73° C.);

means for establishing a filtered stream of air at ambient pressure and temperature;

means to compress said filtered stream of air to an elevated temperature and pressure;

means to cool said compressed stream of air to near ambient temperature without loss of pressure;

means to remove moisture, gaseous contaminants and particulates from said compressed air stream with minimum pressure loss;

means to cool said compressed air stream to a temperature below 0° F. (−17.8° C.);

means to filter particles from said cooled compressed stream of air;

means to expand said cooled compressed stream of air to a temperature below −100° F. (−73° C.) and a pressure slightly greater than ambient;

means to introduce said expanded stream to air into said insulated means; and means to remove cold air from said insulated means after contacting and cooling said articles.

7. A system according to claim 6 wherein said means to cool said compressed air stream includes a heat exchanger and means to remove cold air from said insulated means for use in said heat exchanger for cooling said compressed air stream.

8. A system according to claim 7 wherein there is included means to sterilized air removed from said insulated means after heat exchange and means to use said air at elevated temperature to regenerate said means to remove moisture and gaseous contaminants from said compressed air stream.

9. A system according to claim 8 including a blower to force said air at elevated temperature through said means for removing moisture and gaseous contaminants from said compressed air stream.

10. A system according to claim 7 including means to remove ice particles from said air removed from said insulated means prior to introduction of said air into said heat exchanger.

11. A system according to claim 6 wherein said insulated space in a freezer of the spiral, impingement or tunnel type.

12. A system according to claim 6 wherein said means to compress said stream is a multistage compressor having an integral gear drive to activate said expander.

13. A system according to claim 6 wherein said means to remove moisture and gaseous contaminants from said compressed air stream is pressure swing adsorption unit including a particulate trap for removing particles from said compressed air stream after removal of moisture and gaseous contaminants.

14. A system according to claim 6 wherein said means to compress said stream of air includes an oil free compressor.

* * * * *